United States Patent [19]

Cote

[11] 4,153,888

[45] May 8, 1979

[54] LOW LOSS MICROWAVE SWITCH

[75] Inventor: Maurice R. Cote, Nashua, N.H.

[73] Assignee: Sanders Associates, Inc., Nashua, N.H.

[21] Appl. No.: 840,197

[22] Filed: Oct. 7, 1977

[51] Int. Cl.[2] ..... H01P 1/15

[52] U.S. Cl. ..... 333/262; 333/104; 333/34

[58] Field of Search ..... 333/7 D, 81 A, 84 M, 333/97 S

[56] References Cited

U.S. PATENT DOCUMENTS

| | | | |
|---|---|---|---|
| 3,278,763 | 10/1966 | Grove | 333/7 D X |
| 3,503,014 | 3/1970 | Hall et al. | 333/7 D |
| 3,503,015 | 3/1970 | Coraccio et al. | 333/7 D |
| 3,777,287 | 12/1973 | Louvel | 333/84 M |
| 3,812,438 | 5/1974 | Hopfer | 333/97 S X |
| 3,972,012 | 7/1976 | Liu | 333/84 M |
| 4,030,001 | 6/1977 | Medley, Jr et al. | 333/84 M X |

*Primary Examiner*—Paul L. Gensler

*Attorney, Agent, or Firm*—Louis Etlinger; Joseph E. Funk

[57] ABSTRACT

A diode microwave switch is disclosed having both low power dissipation loss and a low voltage standing wave ratio by the techniques of mounting microwave diodes on pedestals and interconnecting them with air line microstrip connections and utilizing special impedance matching techniques. Voltage standing wave ratios of 1.15:1.00 with 0.3 db loss in a three diode 60 db isolation switch are readily obtained.

12 Claims, 5 Drawing Figures

LOW LOSS MICROWAVE SWITCH

FIELD OF THE INVENTION

This invention relates to an improved diode switch used to pass high frequency electromagnetic energy. More particularly, it relates to a microwave diode switch having low power loss and a low voltage standing wave ratio.

BACKGROUND OF THE INVENTION

The use of diodes as microwave switches is well-known in the art and they offer a number of advantages over mechanical switches. There are no movable switch contacts with the attendant problem of noise caused by poor connections and the lower switch operating speeds caused by mechanical inertia. In addition, diode switches can be fabricated at a lower cost than comparable mechanical switches. Diode switches can also be packed in a smaller volume and, in particular, they are readily incorporated into transmission lines used to carry high-frequency energy.

The radio frequency power that can be controlled by a diode switch is determined by many factors well-known in the art. Several of these factors are:

The frequency of the microwave energy passing through the diode,

The speed at which the diodes are switched between its nonconducting and conducting states, The frequency at which the diode is switched alternately between its conducting and non-conducting states, Power losses within the switch and the voltage standing wave ratio in the switch caused by impedance mismatches therein.

In a typical diode microwave switch isolation in the order of 60 decibels (db) between the input and the output of the switch when the switch is non-conducting is required. In the art it is well known that a single diode can typically provide in the order of 25 db isolation. Accordingly, multiple diodes are used to achieve the desired isolation and, typically, 3 diodes are used to achieve 60 db isolation. Diodes may be connected in series with the transmission line conductors but they are typically connected in shunt across the transmission line conductors through the switch in order to achieve maximum power handling capability while achieving fast switching action. When such a switch is in its open or non-conducting state, all the shunt connected diodes are placed in a conducting state in a manner well known in the art. Vice versa, when such a switch is in a closed or conducting state, the shunt connected diodes are caused not to conduct. Microwave energy input to a shunt connected switch in its open or non-conducting state is reflected back to the input of the switch and, conversely, microwave energy input to a shunt connected switch in its closed or conducting state is coupled to the output of the switch. Such a shunt connected microwave diode switch is disclosed in U.S. Pat. No. 3,959,750, issued May 25, 1976, to Frank Holt.

In Microwave diode switches the conductors are typically mounted on dielectric material which is in turn mounted on or in close proximity to metallic material which is at ground potential. In addition, there are many connections between the small diode chips, the conductors interconnecting the diodes, capacitances, power sources and to connectors by which the microwave energy is input to and output from the switch.

Each transition between differing materials such as between a connector and a conductor mounted on a dielectric substrate, between the conductor and the diodes, as well as between all the other elements typically found within a microwave diode switch normally cause some physical discontinuities or small impedance mismatches which result in power reflections that increase voltage standing wave ratios (VSWR) and dielectric losses within the switch. These are present problems in the microwave diode switch art.

To solve the above-described problems, I provide a novel combination of means for reducing dielectric losses and providing better impedance matches in the diode switch. More particularly, I mount diode chips on individual electrically conductive pedestals and the individual diodes are interconnected by conductors mounted on dielectric substrates which bridge the tops of the pedestals upon which each of the diodes is mounted. In addition, the dielectric mounted conductors are shaped to minimize or eliminate impedance mismatches between conductors and the conductive ribbons which connect the conductors to the diode chips on the pedestals.

My invention with its various advantages and features will appear more fully upon consideration of the following detailed description and the attached drawing in which.

DETAILED DESCRIPTION

Figure 1:
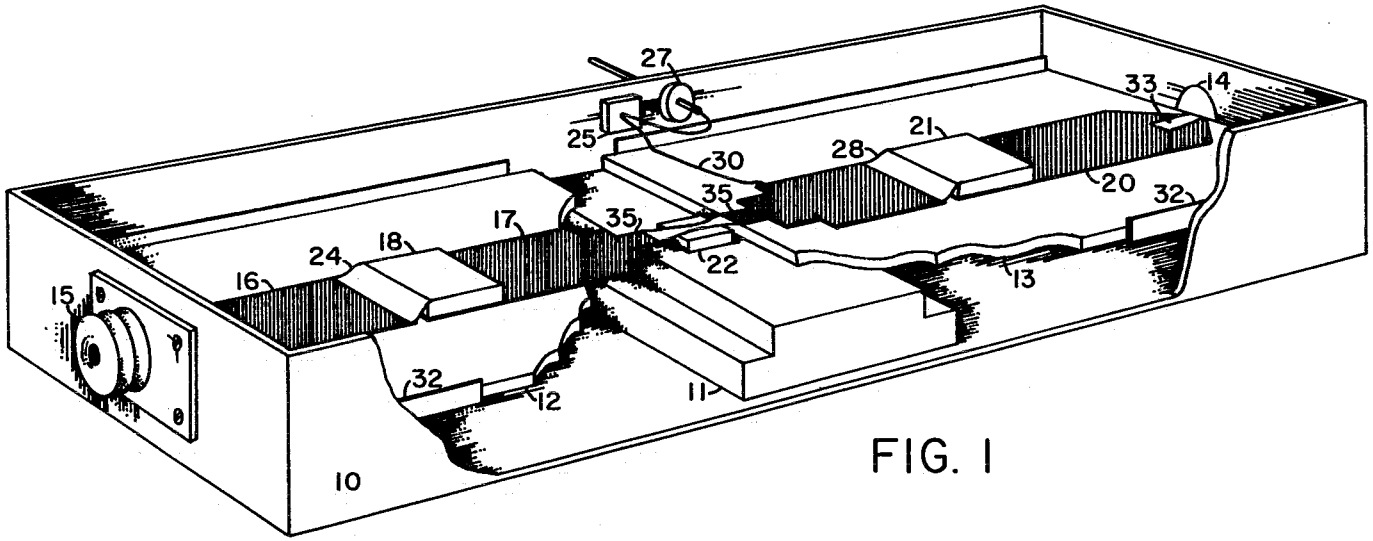
FIG. 1 is a perspective view, partly broken away, of a simple diode microwave switch embodying the invention.
Figure 3:
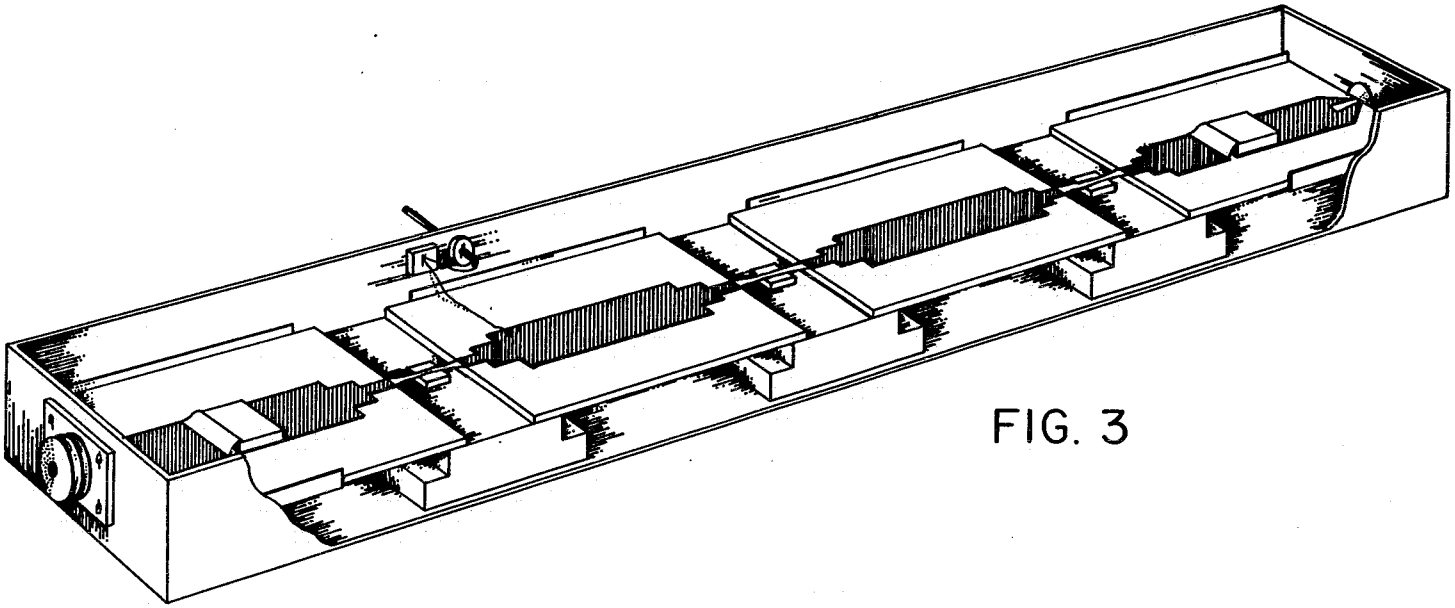
FIG. 3 is a perspective view, partly broken away, of a three diode microwave switch.

In FIG. 1 is shown a perspective view of a microwave diode switch embodying the teaching of my invention. The switch is simplified in that it incorporates only a single p-i-n diode which will yield about 20 db isolation when the switch is in its off state. It would be readily apparent to one skilled in the art in view of the teaching of my invention to add more diodes mounted and connected in the same manner as the single diode described herein in detail to achieve greater isolation. For example, see FIG. 3, showing three diodes mounted and interconnected in the same fashion as shown in FIG. 1 to achieve isolation in the order of 60 db when the switch is in an off or non-conducting state.

The final details of the operation of microwave diode switches are not described herein as they are well known in the art and may be seen, for example, in U.S. Pat. No. 3,296,457, issued Jan. 3, 1967, to R. Robbins et al; and in U.S. Pat. No. 3,959,750, issued May 25, 1976, to F. Holt.

Turning again to FIG. 1, therein is seen a switch case or housing 10, usually constructed of a conductive metal such as aluminum and maintained at an electrical ground potential with respect to the circuitry contained therein. Housing 10 is part of the transmission path through the switch. Located in the end walls of housing 10 are conventional radio frequency connectors 14 and 15 which are used to connect external circuitry applying microwave energy to and remove said energy from the microwave diode switch in a well-known manner. In one embodiment of my invention, these connectors 14 and 15 are American Model 2052-5062 SMA connectors each of which has a tapered ribbon conductor 33 for connecting the connectors 14 and 15 to microstrip or printed circuit type conductors 16 and 20 within the switch in a well-known manner.

Within the microwave diode switch the microstrip copper conductors 16, 17, 19, and 20 which are 0.001 inches thick are mounted on 0.010 inch teflon glass substrates or bases 12 and 13. Substrates 12 and 13 are each supported on one end by pedestal 11 and are supported along their sides by sidewall supports 32, which are shown in part. Other well-known substrate materials are fused quartz and alumina. Pedestal 11 is made of kovar which is electrically connected to housing 10. On top of pedestal 11 is electrically mounted p-i-n diode chip 22 with one terminal of the diode being electrically connected to pedestal 11. Kovar has a thermal coefficient of expansion close to that of diode 22 so that the diode will not break free therefrom under thermal stress occuring during operation of the switch. The second terminal of diode chip 22 is electrically connected to microstrip conductor 17 and 19 by conductive ribbon 23.

When the microwave diode switch contained in housing 10 is in its on or conductive state microwave energy will, for example, be input to the switch by a connector 15, will travel through microstrip conductors 16 and 17, capacitor 18, conductive ribbon 23, microwave strip conductors 19 and 20, capacitor 21, and be output via connector 14 to some other circuitry or load. When the switch is in its off or non-conductive state, diode 22 will be conducting in a manner described further in this specification and the conducting diode provides a shunt from conductor 17 to housing 10 which is at ground potential. This causes the microwave energy input at connector 15 to be reflected back to the input in a manner well known in the art.

The microwave energy passes through the switch also passes through series connected chip capacitors 18 and 21, which typically have a value of 70 picofarads and physical dimensions of 0.080 inches square by 0.006 inches high. Capacitor 18 is mounted on microstrip conductor 17 while capacitor 21 is mounted on microstrip conductor 20. Capacitor 18 is connected to conductor 16 via ribbon conductor 24 while capacitor 21 is connected to conductor 19 via ribbon conductor 28. Capacitors 18 and 21 permit DC voltages to be applied to diode chip 22 to reverse bias the diode to maintain it in its non-conducting state when the microwave switch is "on", or to forward bias diode 22 to its conducting state when the microswitch is in its "off" state. This is described further in the specification.

In many switches the conductors carrying the mircrowave energy are mounted on dielectric materials such as the teflon glass substrates 12 and 13 and the dielectric substrates themselves are mounted or sit directly on the switch housing 10. There is created a capacitance between the conductors and the housing with the substrate being the capacitor dielectric. In a typical microwave diode switch containing three diodes and providing 60 db isolation in the "off" state of the switch, the dielectric or capacitive losses are in the order of 0.8 to 1.0 db. By mounting substrates 12 and 13 in the air and supported by sidewall supports 32 and pedestal 11, such dielectric losses are limited to 0.1 to 0.2 db.

Conductive ribbon 33 of connectors 14 and 15 have a width in the order of 0.50 inches. The ribbon 33 of connector 15 is not shown due to the perspective view of the switch. Microstrip conductor 20 must be connected to ribbon 33 so as to minimize physical discontinuities which cause mismatched impedances that result in an increased voltage standing waveratio (VSWR) for the switch. Accordingly, microstrip conductor 20 and microstrip conductor 16 are tapered near one end thereof as shown from 0.080 inches to 0.050 inches to match the width of conductors 20 and 16 to ribbon conductors 33 of connectors 14 and 15. Connector ribbon 33 has a width of 0.050 inches to match the tapered width of conductor 20. Conductor 16 is similarly matched to connector 15.

Figure 2:
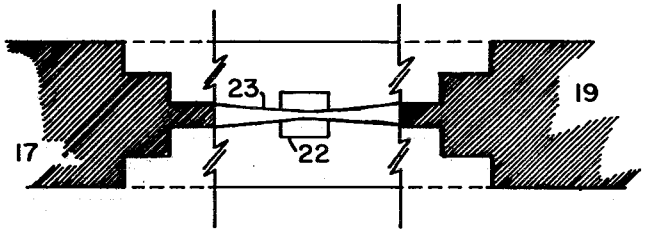
FIG. 2 is an exploded view of part of the microwave diode switch.

The same discontinuity problems that can cause impedance mismatches occur in connection of microstrip conductors 17 and 19 to p-i-n diode chip 22. Unlike the prior art wherein wires are used for such a connection with mismatch problems, I utilize a special tapered ribbon conductor 23 shown in FIG. 1, but shown in detail in FIG. 2. The two ends of conductor 23 are the same width as the microstrip conductors and taper towards the middle to match the dimension of the second terminal of diode 22 which the conductor 23 midpoint is electrically connected to. More particularly, microstrip conductors 17 and 19 are each step tapered from 0.080 inches to 0.020 inches wide at the narrowest ends 35 and 36 of conductor 17 and 19 closest to diode 22. The ends of the conductive ribbon 23 which are connected to the narrowest steps 35 and 36 of conductor 17 and 19 are correspondingly 0.020 inches wide and the ribbon tapers to 0.003 inches at its midpoint as shown in FIG. 2. The narrow midpoint of ribbon conductor 23 is electrically connected to the upper or second terminal of diode 22 which has the same dimension of 0.003 inches. In this manner there are no discontinuities which can cause reflections.

The steps in the ends of conductors 17 and 19 closest to diode 22 can cause impedance mismatches which cause reflections that increase the VSWR. To keep the impedance constant each step in conductors 17 and 19 are located directly above a step in pedestal 11. By placing each step of conductors 17 and 19 directly over a corresponding step of pedestal 11 there are theoretically no impedance mismatches that cause reflected waves, in a manner well-known in the art, that result in an increased voltage standing wave ratio (VSWR) in the switch. In this manner the VSWR is kept to a minimum while making connections from conductors 17 and 19 to diode 22.

While in this embodiment of my invention only two steps on pedestal 11 are utilized, along with the corresponding step tapers 35 of conductors 17 and 19, the numbers of steps shown is only illustrative to teach my invention. In practicality more taper steps and corresponding pedestal steps may be utilized to provide a better impedance match and thereby further decrease the VSWR of the switch. If the number of steps on the pedestal and conductors are infinite, we have a ramp and the slope of the ramp is defined logarithmically.

As capacitors 18 and 21 each have a width of 0.080 inches the width of microstrip conductors 16, 17, 19, and 20 is also 0.080 inches in order to eliminate any discontinuities which might increase the VSWR of the switch. The result of such careful matching of the impedances by the techniques described herein, and through the mounting and interconnection techniques also described, is a VSWR of 1.15:1.0 rather than a VSWR ratio of 1.3:1.0 as found in similar prior art microwave switches having 60 db isolation.

In addition to those components of my novel microwave switch previously described, there is also chip capacitor 25 electrically connected to the sidewall of housing 10 and having a value of 40 picofarads. Capacitor 25 is connected between the ground potential of housing 10 and via forty gauge wire 30 to microstrip conductor 19. To apply DC switching potentials to p-i-n chip diode 22, a power supply (not shown), but well known in the art, applies the DC switching potentials through low capacitance feedthrough 27 to forty gauge wire 30 which connects to the top of capacitor 25 and then connects the DC switching potentials to microstrip conductor 19 to be applied via ribbon conductor 23 to diode 22. The length of conductor 30 from capacitor 25 to conductor 19 is one-quarter wavelength of the frequency of the microwave power to be passed through the switch. This one-quarter wave wire length creates a high impedance to the flow of microwave energy from microstrip conductor 19 through wire 30 in a manner well known in the art.

FIG. 2 is an enlarged top view of pedestal 11, diode 22, microstrip paths 17 and 19 and, particularly, ribbon conductor 23. This figure better shows the shape and connection of conductor 23.

FIG. 3 is an extension of the simple shunt connected diode microwave switch shown in FIG. 1 and described in detail hereinabove. A three diode, shunt connected switch is shown which is merely a multiplicity of the elements of the simple switch. Only the diode driving feedthrough and capacitor, and the input/output DC isolating capacitors are not multiplied. As the switch in FIG. 3 is basically identical to the switch in FIG. 1, except for having more components to provide 60 db isolation rather than the 20 db isolation of the simple switch, no further description is needed. The operation and purpose of the additional components and hardware are the same as those previously described in FIG. 1.

Figure 4:
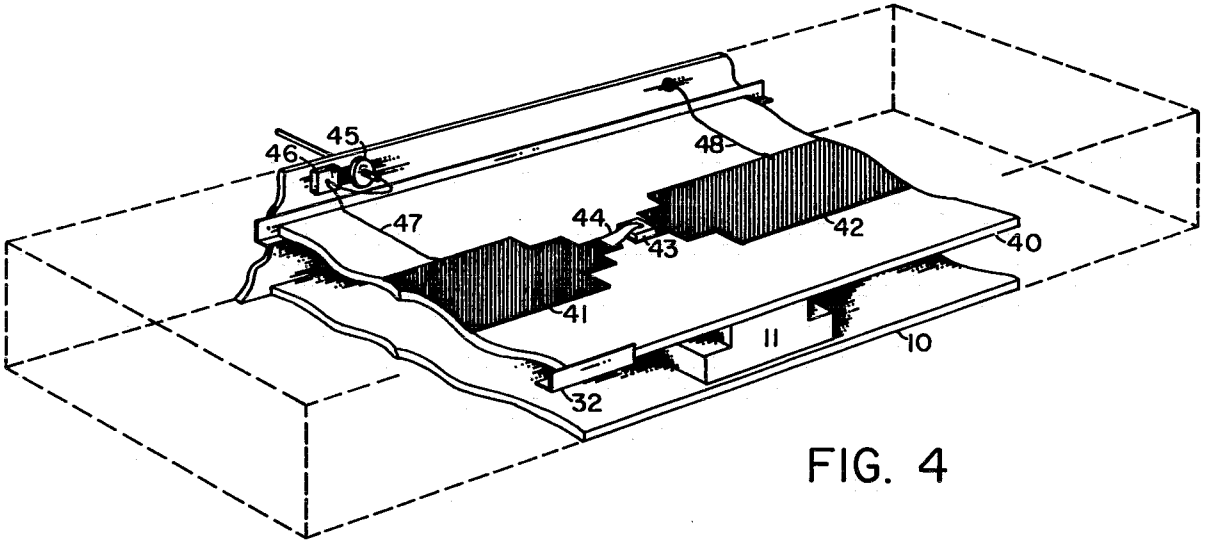
FIG. 4 is a perspective view of only a portion of a series connected diode switch.

Referring now to FIG. 4, therein is shown a perspective view of an alternative embodiment of my invention. The series connected capacitors adjacent to the input and output connectors, and the input and output connectors themselves are not shown as they are identical to those shown in FIG. 1. In this figure is shown a series connected microwave diode switch. In contrast to the switch shown in FIG. 1 wherein there are two substrates 12 and 13, in this embodiment there is only one substrate 40 on which two microstrip conductors 41 and 42 are located, each having the same step down taper as conductors 17 and 19 in FIG. 1. The diode chip 43 is 0.020 inches square and sits on and is electrically connected to the end of the 0.020 inch wide step of conductor 42. Ribbon conductor 44 is 0.020 inches wide and connects the top or second terminal of diode 43 to conductor 41 in the same manner as conductors 24 and 28 in FIG. 1. Identical to the corresponding elements 25, 27 and 30 in FIG. 1, low capacitance feedthrough 45, capacitor 46 and forty gauge wire 47 apply diode switching potentials to diode 43. In addition, forty gauge wire 48 is connected between conductor 42 and housing 10 which is at ground potential to complete a current flow path for the switching currents applied to diode 43. Conductors 47 and 48 each have a length equal to one-quarter the wave length of the microwave energy passing through the switch to provide a current path for the diode switching currents while presenting a high impedance path to the mircrowave energy in a manner well known in the art. In a well known manner series diode 43 can be forward biased into its conducting state and microwave energy input to the switch passes through the diode to the output. Similarly, diode 43 can be biased into its non-conducting or off state wherein energy input to the switch will be reflected back to the input.

While FIG. 4 shows a simplified one diode series connected switch, it would be obvious to one skilled in the art to have more diodes connected in series in the same manner as shown for diode 43 to achieve higher isolation in the off state of the switch.

Figure 5:
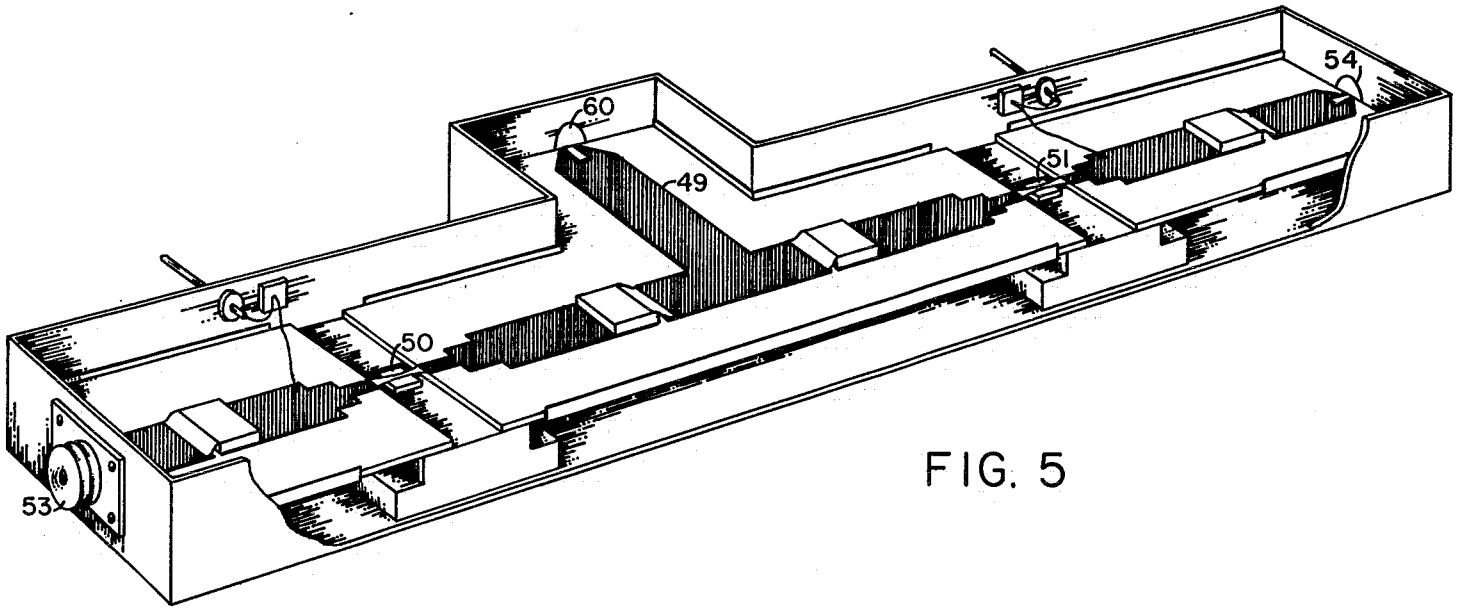
FIG. 5 is a perspective view of only a portion of a multiple throw diode switch utilizing my invention.

Referring now to FIG. 5, therein is shown a simplified single pole double throw microwave diode switch utilizing shunt connected diodes. All details of the diodes, their connection and biasing are identical to that described in reference to FIG. 1. The differences are that energy is input to the switch via connector 60 to conductor 49. Connector 60 is identical to connectors 14 and 15 in FIG. 1. To implement the switch double throw operation only one of diodes 50 and 51 can be in its conducting state at any given time while the other of the two diodes is non-conducting. The individual operation of diodes 50 and 51 is the same as described for diode 22 in FIG. 1. It would also be obvious to one skilled in the art to use more shunt connected diodes on pedestals in series with diode 50 and 51 to achieve any desired higher isolation between input 52 and the outputs 53 and 54.

In addition, it would be obvious to use the switch shown in FIG. 5, in other than double throw operation. Diodes 50 and 51 may be concurrently conducting or non-conducting. Further, while the paths including diodes 50 and 51 only show a switch with two outputs, more branches may be added for any plurality of outputs. Still further, while the diodes 50 and 51 shown in FIG. 5 are shunt connected, all the diodes in these two output branches, or in any plurality of output branches may be series connected in the same manner as shown and described for FIG. 4.

In summary, I disclose a microwave diode switch having carefully matched impedances and having the main energy carrying conductors supported in air to achieve low dielectric power losses and a low voltage standing wave ratio; both resulting in a highly efficient microwave diode switch.

While what I have described hereinabove is at present considered to be the preferred embodiment of the invention, it is illustrative only and it will be obvious to those skilled in the art that various changes and modifications may be made therein without departing from the scope of the invention.

For instance, more than one diode may be utilized in the switch to achieve higher isolation therein; different types of diodes other than the p-i-n diode disclosed herein may be used; different types of input and output connectors may be utilized; or the power switching diodes may be series connected rather than shunt connected as shown in this embodiment of the invention. In addition, multiple throw diode switches may be constructed using the teaching of my invention. Multiple pole switches are merely extensions of the basic switches.

I claim:

1. A switch having a housing and at least one input and at least one output comprising a semi-conductor device mounted on a pedestal to space said device from said housing and being electrically connected to said pedestal, a first conductor supported on said pedestal in a spaced relationship to said housing while being in close proximity to said device, a second conductor supported on said pedestal in a spaced relationship to said housing while being in close proximity to said device, a conductive ribbon the two ends of which have the same width as said first and said second conductors to which either end of said ribbon is respectively connected, and the width of said ribbon decreases gradually and is its narrowest at the midpoint of said ribbon, the midpoint of said ribbon being connected to said device and having the same width as said device at the point to which it is connected, said conductive ribbon matching the impedance of said first and second conductors to the impedance of said device, means for applying control signals to said device to selectively operate said switch, and means for isolating said control signals from input and said outputs of said switch.

2. The switch in accordance with claim 1 wherein said semiconductor device comprises a diode, one terminal of which is electrically connected to said pedestal, and the second terminal of which is electrically connected to the midpoint of said conductive ribbon, said diode being placed in its conducting state by said control signals to shunt said first and said second conductors to said housing to thereby place said switch in its off or non-conducting state, and said diode being placed in its nonconducting state by said control signals to thereby place said switch in its on or conducting state.

3. The switch in accordance with claim 2 wherein said diode is a p-i-n diode.

4. A switch having a housing and at least one input and at least one output comprising a semi-conductor device mounted on and electrically connected to a pedestal having two tapered sides to space said device from said housing, a first tapered conductor supported in a spaced relationship to said housing and being connected to a terminal of said device in a manner to match the impedance of said first conductor to the input impedance of said device terminal, a second tapered conductor supported in a spaced relationship to said housing and being connected to said device terminal in a manner to match the impedance of said second conductor to the input impedance of said device, the tapers of both said conductors and said pedestal cooperating to maintain constant impedance in said conductors as they taper down towards said device, and means for alternately placing said device in a conducting state and a non-conducting state to selectively operate said switch.

5. The switch in accordance with claim 4 wherein both said conductors are step tapered, and said two sides of said pedestal are step tapered with the base of said pedestal being wider than the top of said pedestal and with said device being mounted on the top of said pedestal, with each step in the side of said pedestal corresponding to a step of said conductors.

6. A microwave diode switch having a switch housing at electrical ground potential and comprising a plurality of pedestals made of a conductive material and being electrically connected to said switch housing, a plurality of diode chips having anode and cathode terminals, with one terminal of each of said diodes being electrically connected to the top of each pedestal, at least one electrical connector for applying microwave energy to said switch at least one electrical connector for taking said microwave energy out of said switch a first plurality of capacitors a plurality of dielectric boards having two ends and on each of which are located printed circuit type conductors, each board having two conductors thereon connected in series by one of said first plurality of capacitors, some of said boards being supported on top of each of two pedestals to bridge said two pedestals and to space said conductors on each of said boards from said switch housing and thereby decrease dielectric losses, and the ends of said conductor adjacent to said two ends of each of said boards being of a smaller width than the width of said conductors.

a plurality of conductive ribbons having two ends with the width of both ends of each of said ribbons being the same width as said conductors at the end of said boards supported on said pedestals, each end of a ribbon being electrically connected to bridge the end of the conductor on each of two boards supported on a pedestal, with the width of each of said ribbons being tapered narrower towards its middle so the midpoint of each of said conductive ribbons is the same width as the second terminal of each of said diodes and the midpoint of said ribbon bridging the conductors on two boards supported on a pedestal is electrically connected to the second terminal of the diode mounted on said pedestal, and means for applying biasing potentials to the diode mounted on each of said pedestals, said diodes being biased into either their conducting or non-conducting states to respectively reflect microwave energy input to said switch via said first connector back toward said first connector and to pass said microwave energy input to said switch via said first connector through to said second connector.

7. The microwave diode switch according to claim 6 wherein said pedestals are constructed of a material having a thermal coefficient of expansion close to or equal to the thermal coefficient of expansion of said diodes mounted on top of each of said pedestals.

8. The microwave diode switch according to claim 7 wherein the width of each of the said two conductors on each of said boards away from the ends thereof is the same as the width of said capacitor bridging said two conductors to prevent energy reflections that increase the voltage standing wave ratio of the switch.

9. A switch having a housing and at least one input and at least one output therefrom comprising:

a pedestal having steps in the sides thereof, a substrate supported on top of said pedestal in a spaced relationship to said housing, a first conductor mounted on said substrate with one end thereof being located above said pedestal, a second conductor mounted on said substrate in close proximity to said first conductor with one end thereof being located above said pedestal, a semi-conductor mounted on said one end of said first conductor as to have a first terminal thereof electrically connected to said first conductor, said device being in close proximity to said second conductor, means for connecting a second terminal of said device to said second conductor, and means for alternately placing said device in a conducting state and a non-conducting state to selectively operate said switch.

10. The switch in accordance with claim 9 wherein said alternating means comprises first switching means connected to said first conductor, and second switching means connected to second conductor cooperating with said first switching means to apply switching signals to said device to selectively operate said switch, and further comprising isolation means for blocking said switching signals from said input and said output.

11. The switch in accordance with claim 10 wherein said one end of said first conductor and said one end of said second conductor are step down tapered with each step down being located directly above one of said steps of said pedestal to maintain a constant impedance match, the narrowest end of said step down of said first conductor being the same physical width as said device electrically connected thereto to minimize the voltage standing wave ratio of said switch.

12. The switch in accordance with claim 11 wherein said semiconductor device is a diode series connected between an input and an output and said alternating means either forward biases said diode to conduct to place said switch in its on or conducting state or reverse biases said diode to nonconduct to place said switch in its off or non-conducting state.

* * * * *